US009799252B2

(12) United States Patent
Guo et al.

(10) Patent No.: US 9,799,252 B2
(45) Date of Patent: Oct. 24, 2017

(54) PIXEL ARRAY AND DRIVING METHOD THEREOF, DISPLAY PANEL AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 343 days.

(21) Appl. No.: 14/429,981

(22) PCT Filed: Jul. 25, 2014

(86) PCT No.: PCT/CN2014/083006

§ 371 (c)(1),
(2) Date: Mar. 20, 2015

(87) PCT Pub. No.: WO2015/109799

PCT Pub. Date: Jul. 30, 2015

(65) Prior Publication Data

US 2016/0027362 A1 Jan. 28, 2016

(30) Foreign Application Priority Data

Jan. 26, 2014 (CN) ..... 2014 1 0042295

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2300/0426* (2013.01); *G09G 2300/0452* (2013.01); *G09G 2360/16* (2013.01)

(58) Field of Classification Search
CPC ..... G09G 3/2003; G09G 3/3208; G09G 2360/16; G09G 2300/0452; G09G 2300/0426; H01L 27/14603
(Continued)

(56) References Cited

U.S. PATENT DOCUMENTS

2005/0225575 A1* 10/2005 Brown Elliott ... G02F 1/133514 345/694
2009/0027425 A1 1/2009 Park et al.
2013/0241946 A1* 9/2013 Jeong ..... G09G 3/2074 345/589

FOREIGN PATENT DOCUMENTS

CN 86206190 U 11/1987
CN 101325025 A 12/2008
(Continued)

OTHER PUBLICATIONS

Search Report issued in International Application No. PCT/CN2014/083006, twelve (12) pages.

*Primary Examiner* — Amare Mengistu
*Assistant Examiner* — Gloryvid Figueroa-Gibson
(74) *Attorney, Agent, or Firm* — Nath, Goldberg & Meyer; Joshua B. Goldberg

(57) ABSTRACT

The present invention provides a pixel array which comprises a middle pixel region and an edge pixel region surrounding the middle pixel region, wherein, the middle pixel region comprises a plurality of middle pixel sets, each of which comprises eight sub-pixels arranged around a central point, the eight sub-pixels include two red sub-pixels, two green sub-pixels, two blue sub-pixels and two
(Continued)

supplementary-color sub-pixels, and are arranged in three rows and three columns, the first row includes three sub-pixels, the second row includes two sub-pixels, and the third row includes three sub-pixels. The present invention further provides a driving method of the above pixel array, a display panel including the pixel array and a display device including the display panel.

20 Claims, 15 Drawing Sheets

(58) Field of Classification Search
USPC ..... 345/690, 3.3, 149, 152, 694–695
See application file for complete search history.

(56) References Cited

FOREIGN PATENT DOCUMENTS

| | | | |
|---|---|---|---|
| CN | 102636894 | A | 8/2012 |
| CN | 103325315 | A | 9/2013 |
| CN | 103778882 | A | 5/2014 |
| EP | 2639785 | A2 | 9/2013 |

* cited by examiner

PIXEL ARRAY AND DRIVING METHOD THEREOF, DISPLAY PANEL AND DISPLAY DEVICE

This is a National Phase Application filed under 35 U.S.C. 371 as a national stage of PCT/CN2014/083006, filed Jul. 25, 2014, and claims priority benefit from Chinese Application No. 201410042295.9, filed Jan. 26, 2014, the content of each of which is hereby incorporated by reference in its entirety.

FIELD OF THE INVENTION

The present invention relates to the field of display technology, and particularly relates to a pixel array, a driving method thereof, a display panel including the pixel array and a display device including the display panel.

BACKGROUND OF THE INVENTION

In a current display panel, as a common pixel design, three sub-pixels (including a red sub-pixel, a green sub-pixel, and a blue sub-pixel) or four sub-pixels (including a red sub-pixel, a green sub-pixel, a blue sub-pixel, and a white sub-pixel) constitute one pixel for display.

If pixel per inch (PPI) of a display panel is small, a user would obviously feel a granular sensation (i.e., edges of a displayed image are not smooth, but serrated) when watching a display screen. With users' increasing demand on viewing experience of the display screen, the PPI of the display panel needs to be increased. An increase in PPI of the display panel may add difficulty to a manufacturing process of the display panel.

It has become an urgent technical problem in the field how to reduce the granular sensation of the display panel to achieve a display effect of a display panel with higher resolution in the same size, without adding difficulty to the manufacturing process (i.e., without increasing PPI).

SUMMARY OF THE INVENTION

An object of the present invention is to provide a pixel array, a driving method thereof, a display panel including the pixel array and a display device including the display panel. By using the driving method to drive the pixel array, the granular sensation of the display panel can be reduced, and a display effect of a display panel with higher resolution in the same size is achieved.

In order to achieve the above object, as an aspect of the present invention, there is provided a pixel array, which comprises a middle pixel region and an edge pixel region surrounding the middle pixel region, the middle pixel region comprises a plurality of middle pixel sets, each of which comprises eight sub-pixels arranged around a central point, the eight sub-pixels comprise two red sub-pixels, two green sub-pixels, two blue sub-pixels and two supplementary-color sub-pixels, and are arranged in three rows and three columns, the first row includes three sub-pixels, the second row includes two sub-pixels, and the third row includes three sub-pixels.

Optionally, in each middle pixel set, the sub-pixels in the first row are a blue sub-pixel, a red sub-pixel and a supplementary-color sub-pixel sequentially, the sub-pixels in the second row are a green sub-pixel and a blue sub-pixel sequentially, and the sub-pixels in the third row are a red sub-pixel, a supplementary-color sub-pixel and a green sub-pixel sequentially; or in each middle pixel set, the sub-pixels in the first row are a blue sub-pixel, a supplementary-color sub-pixel and a red sub-pixel sequentially, the sub-pixels in the second row are a green sub-pixel and a green sub-pixel sequentially, and the sub-pixels in the third row are a red sub-pixel, a supplementary-color sub-pixel and a blue sub-pixel sequentially; or in each middle pixel set, the sub-pixels in the first row are a blue sub-pixel, a supplementary-color sub-pixel and a blue sub-pixel sequentially, the sub-pixels in the second row are a green sub-pixel and a supplementary-color sub-pixel sequentially, and the sub-pixels in the third row are a red sub-pixel, a green sub-pixel and a red sub-pixel sequentially; or in each middle pixel set, the sub-pixels in the first row are a blue sub-pixel, a blue sub-pixel and a supplementary-color sub-pixel sequentially, the sub-pixels in the second row are a green sub-pixel and a supplementary-color sub-pixel sequentially, and the sub-pixels in the third row are a green sub-pixel, a red sub-pixel and a red sub-pixel sequentially.

Optionally, the supplementary-color sub-pixel is any one of a white sub-pixel, a yellow sub-pixel, an orange sub-pixel, a cyan sub-pixel and a purple sub-pixel.

Optionally, each sub-pixel is of an elongated shape, and in the middle pixel set, the eight sub-pixels are radially arranged around the central point.

Optionally, the edge pixel region comprises:

an upper edge region, comprising a plurality of upper edge pixel sets, each of which comprises five sub-pixels, which are the same as the sub-pixels in the second and third rows of the middle pixel set, wherein, the upper edge pixel sets in the upper edge region are aligned with the middle pixel sets in respective columns in the middle pixel region, respectively;

a lower edge region, comprising a plurality of lower edge pixel sets, each of which comprises five sub-pixels, which are the same as the sub-pixels in the first and second rows of the middle pixel set, wherein, the lower edge pixel sets in the lower edge region are aligned with the middle pixel sets in the respective columns in the middle pixel region, respectively;

a left edge region, comprising a plurality of left edge pixel sets, each of which comprises five sub-pixels, which are the same as the sub-pixels in the second and third columns of the middle pixel set, wherein, the respective left edge pixel sets in the left edge region are aligned with the middle pixel sets in respective rows in the middle pixel region, respectively;

a right edge region, comprising a plurality of right edge pixel sets, each of which comprises five sub-pixels, which are the same as the sub-pixels in the first and second columns of the middle pixel set;

a top left corner pixel set, which is located on the left side of the upper edge region and on the upper side of the left edge region and comprises three sub-pixels, which are the sub-pixel in row two, column three of the middle pixel set, the sub-pixel in row three, column three of the middle pixel set and the sub-pixel in row three, column two of the middle pixel set, respectively;

a top right corner pixel set, which is located on the right side of the upper edge region and on the upper side of the right edge region and comprises three sub-pixels, which are the sub-pixel in row two, column one of the middle pixel set, the sub-pixel in row three, column one of the middle pixel set and the sub-pixel in row three, column two of the middle pixel set, respectively;

a bottom left corner pixel set, which is located on the lower side of the left edge region and on the left side of the lower edge region and comprises three sub-pixels, which are the sub-pixel in row one, column two of the middle pixel set, the sub-pixel in row one, column three of the middle pixel set and the sub-pixel in row two, column three of the middle pixel set, respectively; and a bottom right corner pixel set, which is located on the lower side of the right edge region and on the right side of the lower edge region and comprises three sub-pixels, which are the sub-pixel in row one, column one of the middle pixel set, the sub-pixel in row one, column two of the middle pixel set and the sub-pixel in row two, column one of the middle pixel set, respectively.

As another aspect of the present invention, a driving method of a pixel array is provided, wherein, the pixel array is the above pixel array provided by the present invention, and the driving method comprises steps of:

S1, calculating theoretical brightness values of respective sub-pixels for an image to be displayed according to colors of respective pixels of the image to be displayed;

S2, calculating actual brightness values of the respective sub-pixels, wherein, the actual brightness value of each sub-pixel to be calculated includes a sum of a part of the theoretical brightness value of the sub-pixel to be calculated and at least a part of the theoretical brightness value of at least one sub-pixel adjacent to and having the same color as the sub-pixel to be calculated; and S3, inputting signals to the respective sub-pixels so as to cause brightnesses of the respective sub-pixels to reach the actual brightness values calculated at step S2.

Optionally, when the sub-pixel to be calculated is located in the middle pixel set, in step S2, the actual brightness value of the sub-pixel to be calculated comprises a sum of a part of the theoretical brightness value of the sub-pixel to be calculated and at least parts of the theoretical brightness values of a plurality of sub-pixels adjacent to and having the same color as the sub-pixel to be calculated, and the plurality of sub-pixels adjacent to the sub-pixel to be calculated surround the sub-pixel to be calculated.

Optionally, in the pixel array, any two adjacent sub-pixels have different colors, and in step S2, the number of the sub-pixels surrounding the sub-pixel to be calculated and adjacent to and having the same color as the sub-pixel to be calculated is four.

Optionally, in the middle pixel region, four sub-pixels corresponding to each pixel of the image to be displayed are four sub-pixels having different colors and in a same middle pixel set.

Optionally, in the middle pixel region, four sub-pixels corresponding to each pixel of the image to be displayed are four sub-pixels having different colors and located in different middle pixel sets.

Optionally, in the pixel array, in each middle pixel set, two sub-pixels in the second row have the same color, and two sub-pixels in the second column have the same color; when the sub-pixel to be calculated is located in the middle pixel set, in step S2, the number of the sub-pixels surrounding the sub-pixel to be calculated and adjacent to and having the same color as the sub-pixel to be calculated is eight when one of the two sub-pixels in the second row is the sub-pixel to be calculated, and the number of the sub-pixels surrounding the sub-pixel to be calculated and adjacent to and having the same color as the sub-pixel to be calculated is eight when one of the two sub-pixels in the second column is the sub-pixel to be calculated.

Optionally, in the middle pixel region, four sub-pixels corresponding to each pixel of the image to be displayed are four sub-pixels having different colors and in a same middle pixel set.

As another aspect of the present invention, a display panel is provided, and the display panel comprises a pixel array, which is the above pixel array provided by the present invention.

As still another aspect of the present invention, a display device is provided, the display device comprises a display panel, which is the above display panel provided by the present invention.

In each middle pixel set, eight sub-pixels are arranged surrounding the central point in a "米"-shaped pattern. When an image is displayed by using a pixel array including the middle pixel sets according to the driving method provided by the present invention, the granular sensation of the display panel including the pixel array can be reduced, and a display effect of a display panel with higher resolution in the same size can be achieved.

BRIEF DESCRIPTION OF THE DRAWINGS

The accompanying drawings, constituting a part of the specification, are used for providing a further understanding of the present invention, and explaining the present invention in conjunction with the following specific implementations, rather than limiting the present invention. In the drawings.

DETAILED DESCRIPTION OF THE EMBODIMENTS

Specific implementations of the present invention will be described in detail below in conjunction with the accompanying drawings. It should be understood that the specific implementations described herein are merely used for illustrating and explaining the present invention, rather than limiting the present invention.

As an aspect of the present invention, as shown in FIGS. 1 to 16, there is provided a pixel array, which comprises a middle pixel region and an edge pixel region surrounding the middle pixel region, the middle pixel region comprises a plurality of middle pixel sets, each of which comprises eight sub-pixels disposed around a central point, the eight sub-pixels include two red sub-pixels R, two green sub-pixels G, two blue sub-pixels B and two supplementary-color sub-pixels X, and are arranged in three rows and three columns, the first row includes three sub-pixels, the second row includes two sub-pixels, and the third row includes three sub-pixels.

It should be noted that, in FIGS. 4 to 16, L1, L2, . . . , L12 denote sub-pixels in rows L1, L2, . . . , L12, respectively; R1, R2, . . . , R14 denote sub-pixels in columns R1, R2, . . . , R14, respectively; l2, l3 and l4 denote middle pixel sets in rows l2, l3 and l4, respectively; and r2, r3 and r4 denote middle pixel sets in columns r2, r3 and r4, respectively. The middle pixel sets are arranged in the same way as the central points of the middle pixel sets.

Figure 1:
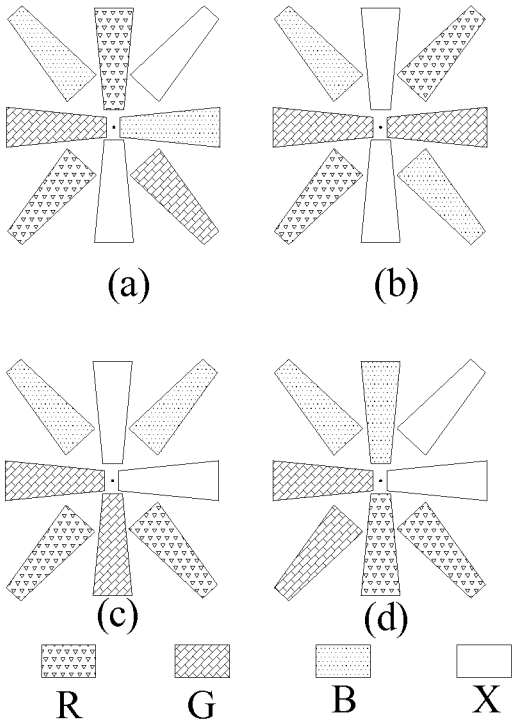
FIG. 1 illustrates four different implementations of a middle pixel set in a pixel array provided by the present invention.

As shown in FIGS. 1(*a*) to 1(*d*), in each middle pixel set, eight sub-pixels are arranged around a central point in a "米"-shaped pattern. When an image is displayed by using a pixel array including the middle pixel sets shown in FIGS. 1(*a*) to 1(*d*) according to a driving method, as described below, provided by the present invention, the granular sensation of a display panel including the pixel array can be reduced, and a display effect of a display panel with higher resolution in the same size can be achieved.

Figure 2:
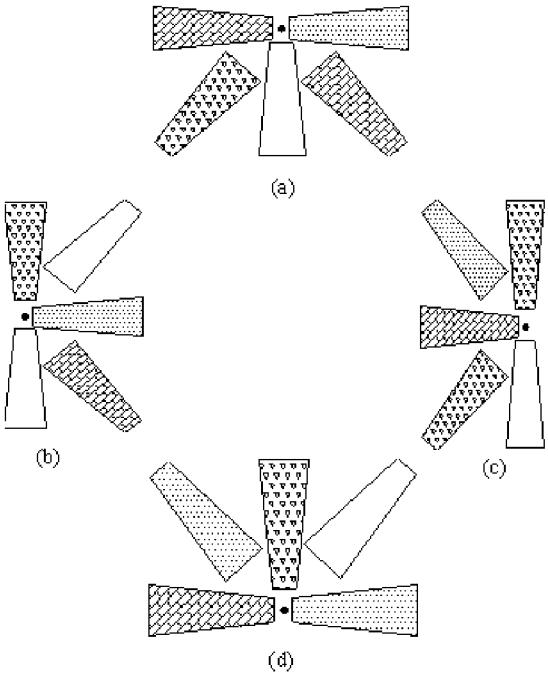
FIG. 2 illustrates implementations of edge pixels in a pixel array provided by the present invention.

The edge pixel region is provided for rendering the pixel array with neater edges, and thus the display panel including the pixel array can obtain a more uniform image when displaying an image. Therefore, the edge pixel region should be able to ensure that no serrated edge occurs in the pixel array. For example, FIG. 2 illustrates specific implementations of edge pixels.

It should be understood that, the pixel arrays shown in the accompanying drawings are merely used for the purpose of clarity, and in practical applications, a pixel array may comprise more rows and more columns of sub-pixels.

In the present invention, arrangement way of sub-pixels in each middle pixel set is not particularly limited. For example, in the implementation shown in FIG. 1(*a*), in each middle pixel set, sub-pixels in the first row are a blue sub-pixel B, a red sub-pixel R and a supplementary-color sub-pixel X sequentially, sub-pixels in the second row are a green sub-pixel G and a blue sub-pixel B sequentially, and sub-pixels in the third row are a red sub-pixel R, a supplementary-color sub-pixel X and a green sub-pixel G sequentially.

In the implementation shown in FIG. 1(*b*), in each middle pixel set, sub-pixels in the first row are a blue sub-pixel B, a supplementary-color sub-pixel X and a red sub-pixel R sequentially, sub-pixels in the second row are a green sub-pixel G and a green sub-pixel G sequentially, and sub-pixels in the third row are a red sub-pixel R, a supplementary-color sub-pixel X and a blue sub-pixel B sequentially.

In the implementation shown in FIG. 1(*c*), in each middle pixel set, sub-pixels in the first row are a blue sub-pixel B, a supplementary-color sub-pixel X and a blue sub-pixel B sequentially, sub-pixels in the second row are a green sub-pixel G and a supplementary-color sub-pixel X sequentially, and sub-pixels in the third row are a red sub-pixel R, a green sub-pixel G and a red sub-pixel R sequentially.

In the implementation shown in FIG. 1(*d*), in each middle pixel set, sub-pixels in the first row are a blue sub-pixel B, a blue sub-pixel B and a supplementary-color sub-pixel X sequentially, sub-pixels in the second row are a green sub-pixel G and a supplementary-color sub-pixel X sequentially, and sub-pixels in the third row are a green sub-pixel G, a red sub-pixel R and a red sub-pixel R sequentially.

In the present invention, arrangement way of a middle pixel set is not limited to the above implementations, and may have other forms of modifications and combinations. Specific color of the supplementary-color sub-pixel X is also not particularly limited, and may be set according to demands of a user. For example, when the supplementary-color sub-pixel is a white sub-pixel, brightness of the display panel including the pixel array can be increased. When the supplementary-color sub-pixel X is any one of a yellow sub-pixel, an orange sub-pixel, a cyan sub-pixel and a purple sub-pixel, color gamut of the display panel including the pixel array can be enlarged.

In the present invention, shape of each sub-pixel is not particularly limited. In the specific implementations provided by the present invention, each sub-pixel is in an elongated shape (i.e., size of the sub-pixel in one direction is larger than that in the other direction), and in the middle pixel set, eight sub-pixels are radially arranged around a central point.

The specific implementations of the middle pixel region have been described above, and specific implementations of the edge pixel region will be described hereinafter.

As shown in FIGS. 4 to 16, the edge pixel region may include an upper edge region, a lower edge region, a left edge region, a right edge region, a top left corner pixel set, a top right corner pixel set, a bottom left corner pixel set and a bottom right corner pixel.

The upper edge region comprises a plurality of upper edge pixel sets, and as shown in FIG. 2(*a*), each upper edge pixel set comprises five sub-pixels, which are arranged in the same way as sub-pixels in the second and third rows of a middle pixel set. That is to say, the five sub-pixels in the upper edge pixel set are arranged in the same way as the remaining five sub-pixels, other than the three sub-pixels above a central point, in the middle pixel set. The upper edge pixel set also comprises a central point, and the five sub-pixels surrounding the central point are also radially arranged, but the difference lies in that there is no sub-pixel above the central point. Colors and arrangement sequence of the five sub-pixels in an upper edge pixel set are the same as those of the sub-pixels in the second and third rows of a middle pixel set. For example, in the implementation shown in FIG. 4, sub-pixels in the second row of a middle pixel set are a green sub-pixel G and a blue sub-pixel B, respectively, sub-pixels in the third row of the middle pixel set are a red sub-pixel R, a supplementary-color sub-pixel X and a green sub-pixel G, respectively, therefore, sub-pixels in the first row of an upper edge pixel set are a green sub-pixel G and a blue sub-pixel B, respectively, and sub-pixels in the second row of the upper edge pixel set are a red sub-pixel R, a supplementary-color sub-pixel X and a green sub-pixel G, respectively. This configuration can make color more uniform when displaying an image. It can be easily understood that, the number of the upper edge pixel sets in the upper edge region is the same as the number of columns of the middle pixel sets in the middle pixel region, and the central points of the upper edge pixel sets in the upper edge region are aligned with those of the middle pixel sets in the respective columns in the middle pixel region.

In addition, FIGS. 2(*b*) to 2(*d*) illustrate a left edge pixel set included in the left edge region, a right edge pixel set included in the right edge region and a lower edge pixel set included in the lower edge region, respectively. Similar to the above-described upper edge pixel set, the left edge pixel set, the right edge pixel set and the lower edge pixel set each comprise five sub-pixels same as corresponding sub-pixels in a middle pixel set. Moreover, colors and arrangement sequence of the respective sub-pixels are the same as those of the corresponding sub-pixels in the middle pixel set, and are not repeatedly described herein.

Figure 3:
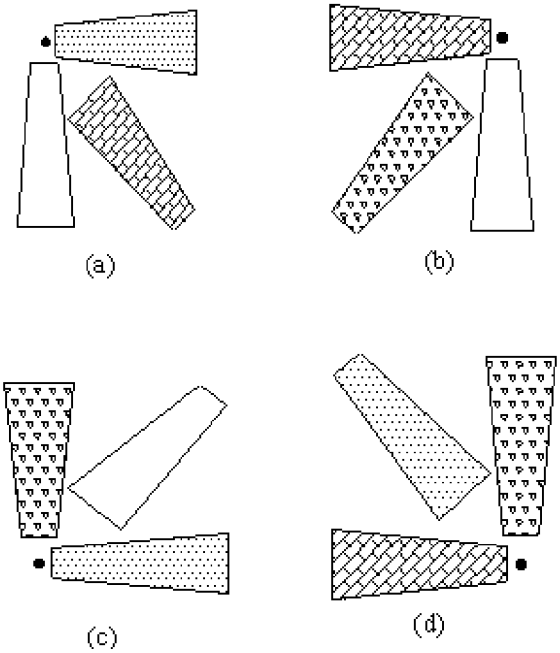
FIG. 3 illustrates implementations of corner pixels in a pixel array provided by the present invention.

The top left corner pixel set is located on the left side of the upper edge region and on the upper side of the left edge region, and as shown in FIG. 3(*a*), the top left corner pixel set comprises three sub-pixels, which are the same as corresponding sub-pixels in a middle pixel set, respectively. For, example, in the implementation shown in FIG. 4, a sub-pixel in row two, column three of a middle pixel set is a blue sub-pixel B, a sub-pixel in row three, column three thereof is a green sub-pixel G, a sub-pixel in row three, column two thereof is a supplementary-color sub-pixel X, and therefore, the three sub-pixels of the top left corner pixel set are a blue sub-pixel B, a green sub-pixel G and a supplementary-color sub-pixel X, respectively, and are arranged in the same way as the three corresponding sub-pixels in the middle pixel set.

In addition, FIGS. 3(*b*) to 3(*d*) illustrate the top right corner pixel set, the bottom left corner pixel set and the bottom right corner pixel set, respectively. Similar to the above-described top left corner pixel set, the top right corner pixel set, the bottom left corner pixel set and the bottom right corner pixel set each include three sub-pixels same as corresponding sub-pixels in a middle pixel set. Moreover, colors and arrangement sequence of the respective sub-pixels are the same as those of the corresponding sub-pixels in the middle pixel set, and are not repeatedly described herein.

It can be easily understood that, the "same" described above refers to not only the same color but also the same arrangement way.

As another aspect of the present invention, there is provided a driving method of the above pixel array provided by the present invention, wherein, the driving method comprises:

S1, calculating theoretical brightness values of respective sub-pixels for an image to be displayed according to colors of respective pixels of the image to be displayed;

S2, calculating actual brightness values of the respective sub-pixels, wherein, the actual brightness value of each sub-pixel to be calculated includes a sum of a part of the theoretical brightness value of the sub-pixel to be calculated and at least a part of the theoretical brightness value of at least one sub-pixel adjacent to and having the same color as the sub-pixel to be calculated; and S3, inputting signals to the respective sub-pixels so as to cause brightnesses of the respective sub-pixels to reach the actual brightness values calculated at step S2.

It can be easily understood that, each image to be displayed consists of a plurality of pixels, each of which comprises a plurality of sub-pixels (in the present invention, each pixel comprises a red sub-pixel R, a green sub-pixel G, a blue sub-pixel B and a supplementary-color sub-pixel X), and pixels in different colors can be obtained by adjusting the brightnesses of the sub-pixels.

In step S3 of the driving method provided by the present invention, the actual brightness output to each sub-pixel at least comprises a sum of a part of the theoretical brightness value of the sub-pixel and at least a part of the theoretical brightness value of at least one sub-pixel adjacent to and having the same color as the sub-pixel. That is, in display, one sub-pixel shares brightness signal(s) of other sub-pixel(s) adjacent to and having the same color as the one sub-pixel, so that transition between adjacent sub-pixels becomes smoother. By using the above method to drive the pixel array, the granular sensation of a display panel including the pixel array provided by the present invention can be reduced, and a display effect of a display panel with higher resolution in the same size can be achieved.

For example, as an implementation of the present invention, when the sub-pixel to be calculated is located in the middle pixel set, in step S2, the actual brightness value of the sub-pixel to be calculated comprises a sum of a part of the theoretical brightness value of the sub-pixel to be calculated and at least parts of the theoretical brightness values of a plurality of sub-pixels adjacent to and having the same color as the sub-pixel to be calculated, and the plurality of sub-pixels adjacent to the sub-pixel to be calculated surround the sub-pixel to be calculated.

When any two adjacent sub-pixels in the pixel array have different colors, in step S2, the number of the sub-pixels surrounding the sub-pixel to be calculated and adjacent to and having the same color as the sub-pixel to be calculated is four. FIGS. 2 to 9 illustrate such implementation.

Figure 4:
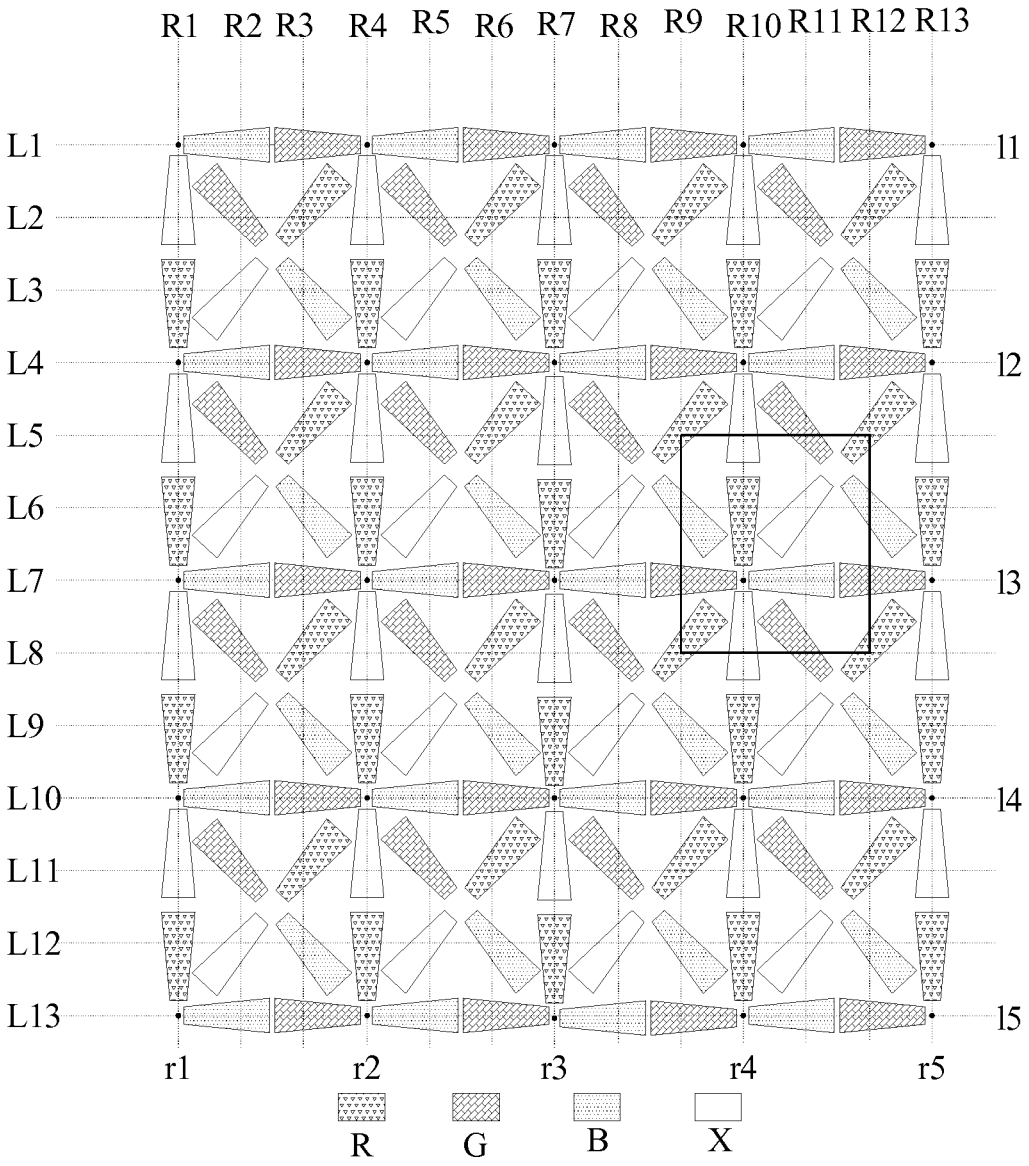
FIG. 4 illustrates sub-pixels which need to be used when calculating an actual brightness value of a sub-pixel in row L6, column R10, in a pixel array including a middle pixel set shown in FIG. 1(*a*)

As shown in FIG. 4, when calculating the actual brightness value of a red sub-pixel R in row L6, column R10, in addition to the theoretical brightness value of the red sub-pixel R in row L6, column R10 itself, theoretical brightness values of a red sub-pixel R in row L5, column R9, a red sub-pixel R in row L5, column R12, a red sub-pixel R in row L8, column R9 and a red sub-pixel R in row L8, column R12 need to be used.

Figure 5:
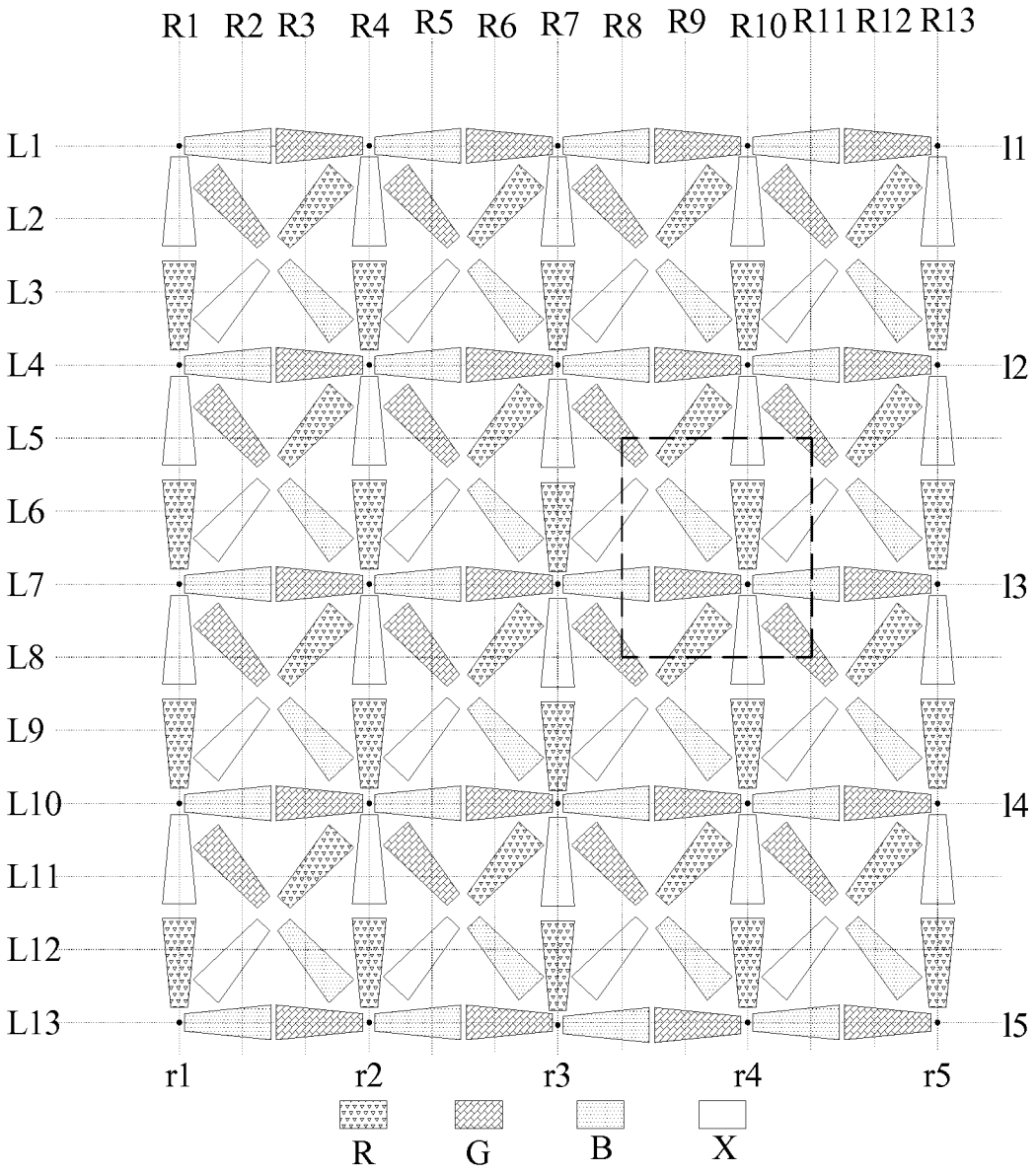
FIG. 5 illustrates sub-pixels which need to be used when calculating an actual brightness value of a sub-pixel in row L7, column R9, in a pixel array including the middle pixel set shown in FIG. 1(*a*)

As shown in FIG. 5, when calculating the actual brightness value of a green sub-pixel G in row L7, column R9, in addition to the theoretical brightness value of the green sub-pixel G in row L7, column R9 itself, theoretical brightness values of a green sub-pixel G in row L5, column R8, a green sub-pixel G in row L5, column R11, a green sub-pixel G in row L8, column R8 and a green sub-pixel G in row L8, column R11 need to be used.

Figure 6:
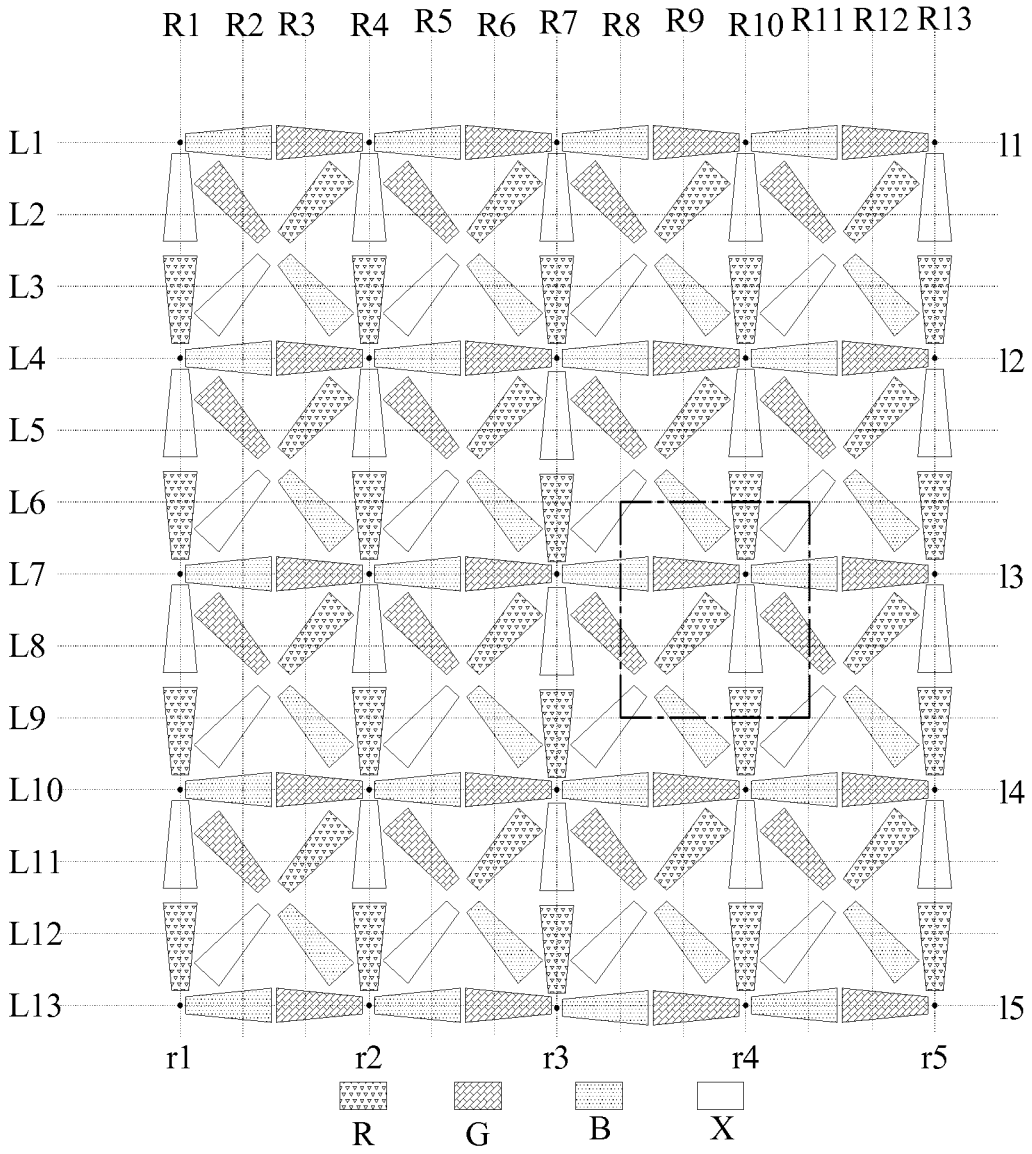
FIG. 6 illustrates sub-pixels which need to be used when calculating an actual brightness value of a sub-pixel in row L8, column R10, in a pixel array including the middle pixel set shown in FIG. 1(*a*)

As shown in FIG. 6, when calculating the actual brightness value of a supplementary-color sub-pixel X in row L8, column R10, in addition to the theoretical brightness value of the supplementary-color sub-pixel X in row L8, column R10 itself, theoretical brightness values of a supplementary-color sub-pixel X in row L6, column R8, a supplementary-color sub-pixel X in row L6, column R11, a supplementary-color sub-pixel X in row L9, column R8 and a supplementary-color sub-pixel X in row L9, column R11 need to be used.

Figure 7:
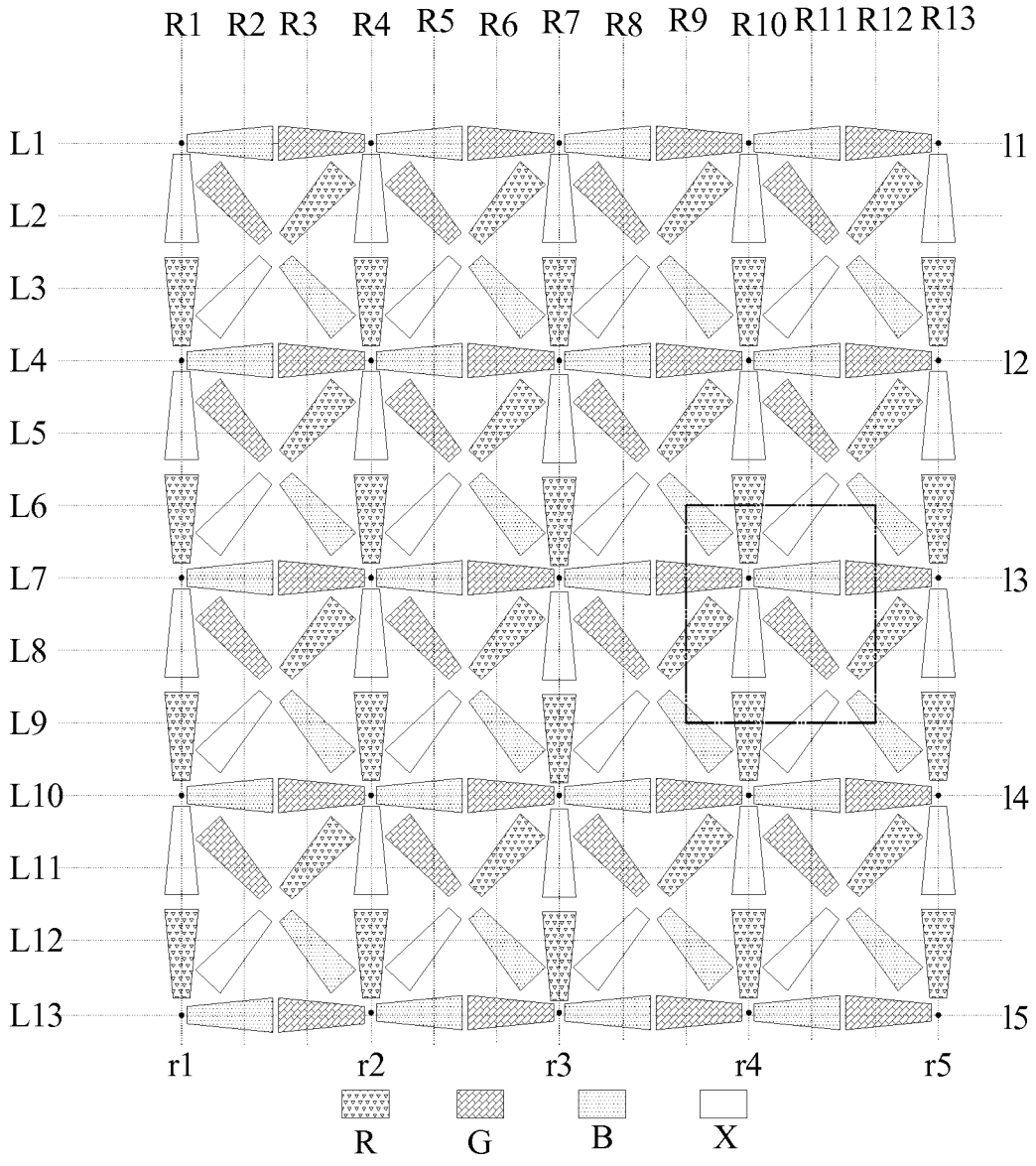
FIG. 7 illustrates sub-pixels which need to be used when calculating an actual brightness value of a sub-pixel in row L7, column R11, in a pixel array including the middle pixel set shown in FIG. 1(*a*)

As shown in FIG. 7, when calculating the actual brightness value of a blue sub-pixel B in row L7, column R11, in addition to the theoretical brightness value of the blue sub-pixel B in row L7, column R11 itself, theoretical brightness values of a blue sub-pixel B in row L6, column R9, a blue sub-pixel B in row L6, column R12, a blue sub-pixel B in row L9, column R9 and a blue sub-pixel B in row L9, column R12 need to be used.

As described above, each pixel of the image to be displayed corresponds to four sub-pixels. As a first implementation of the present invention, in the middle pixel region, the four sub-pixels corresponding to each pixel may be four sub-pixels having different colors and in a same middle pixel set.

Figure 8:
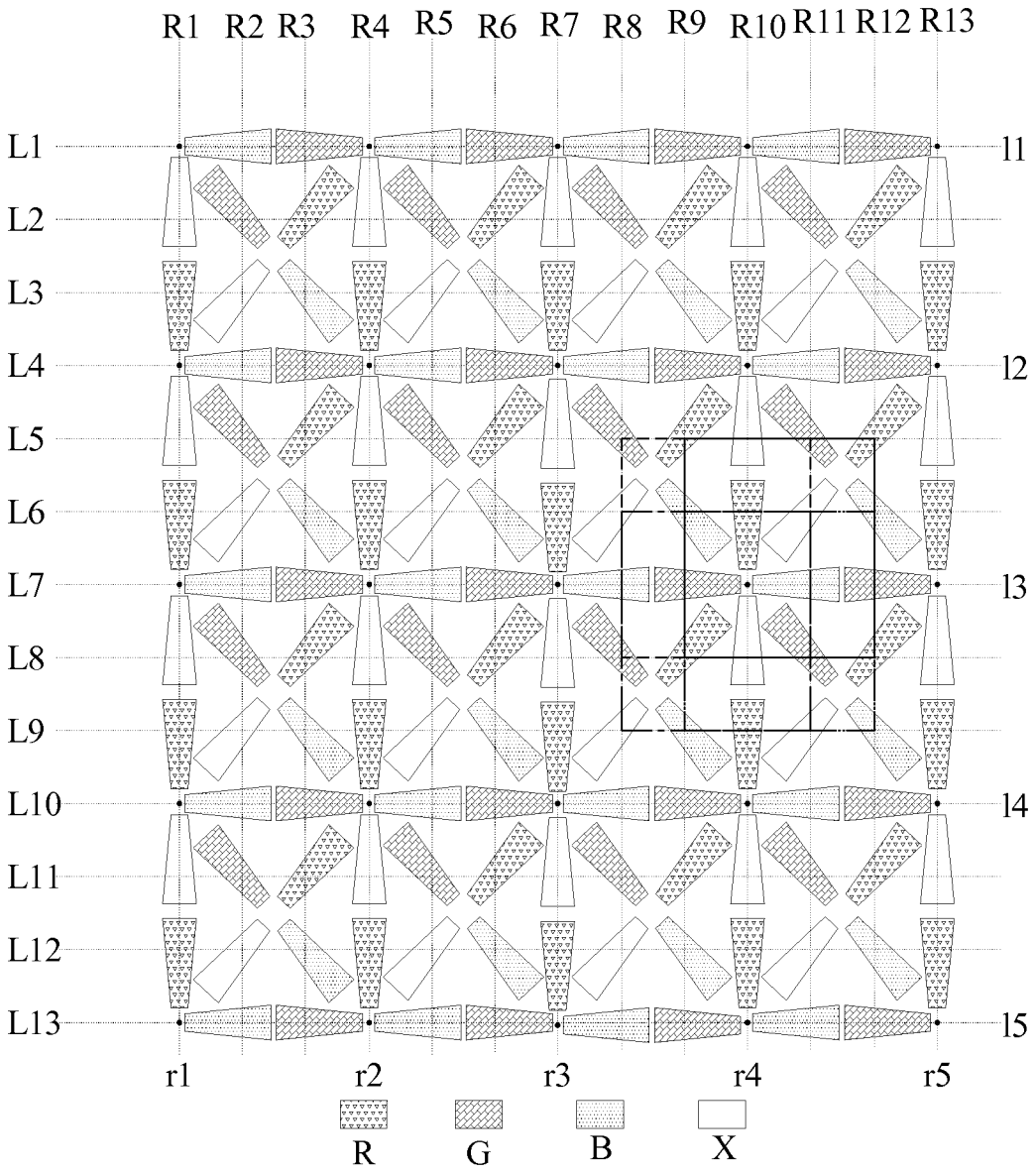
FIG. 8 illustrates a first implementation of sub-pixels which need to be used when calculating actual brightness values of respective sub-pixels in one pixel in an image to be displayed in the case that all of the sub-pixels corresponding to the one pixel are located in a middle pixel set in row 13, column r4, in a pixel array including the middle pixel set shown in FIG. 1(*a*)

As shown in FIG. 8, according to the first implementation of the present invention, in a middle pixel set in row 13, column r4, a red sub-pixel in row L6, column R10, a green sub-pixel G in row L7, column R9, a supplementary-color sub-pixel X in row L8, column R10 and a blue sub-pixel B in row L7, column R11 are four sub-pixels, having different colors, of a same pixel. In this implementation, sampling areas (i.e., an area enclosed by lines sequentially connecting the central points of sub-pixels adjacent to and having the same color as the sub-pixel to be calculated that are required to be used when calculating the actual brightness value of the sub-pixel to be calculated) of sub-pixels of respective colors are overlapped orderly, an overlapping area between the sampling areas of sub-pixels of two different colors is the same, colors thereof are complementary, effect of output image is good, the overall sampling area has a small area, and high definition display can be achieved.

Figure 9:
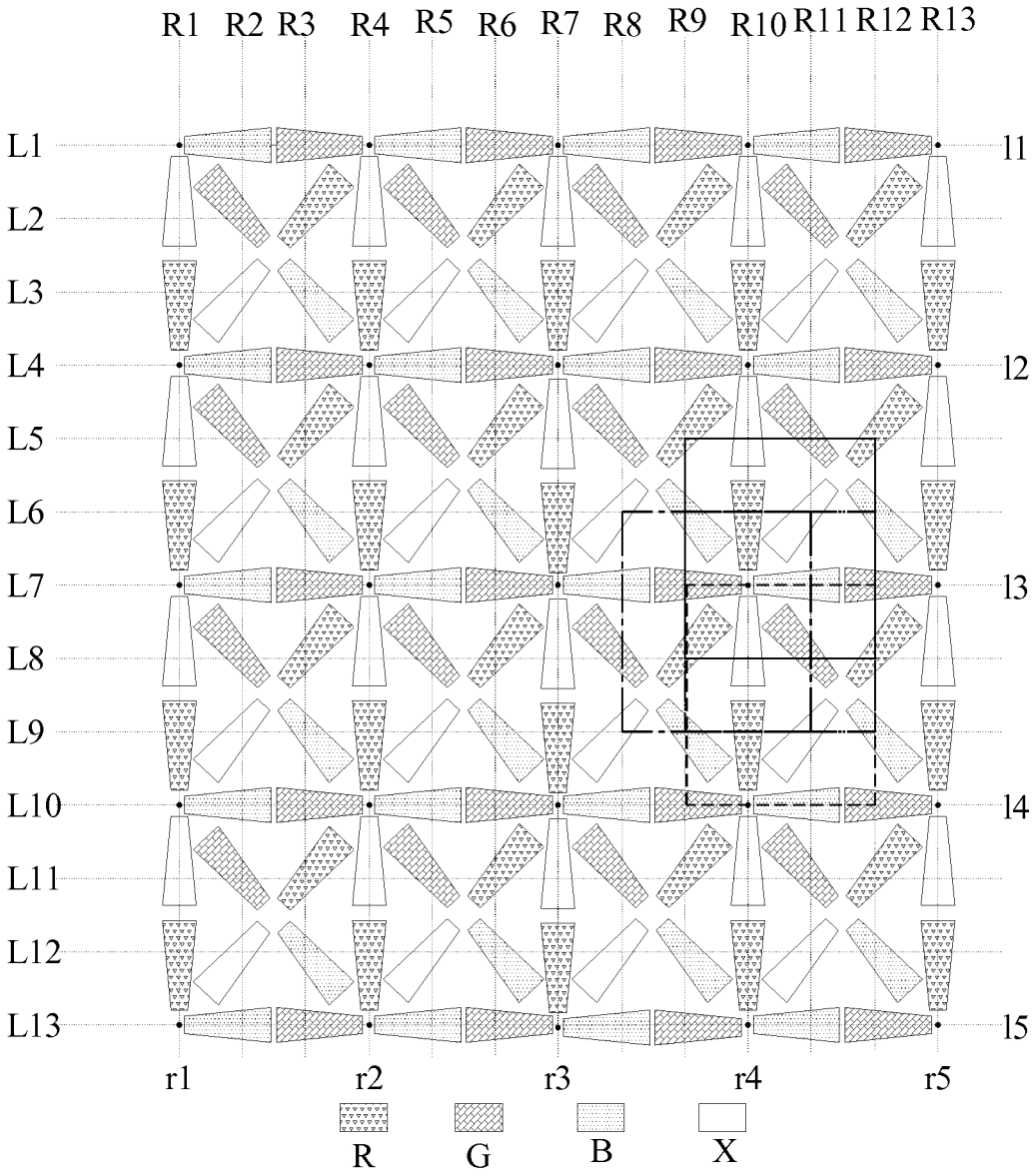
FIG. 9 illustrates a second implementation of sub-pixels which need to be used when calculating actual brightness values of respective sub-pixels in one pixel in an image to be displayed in the case that all of the sub-pixels corresponding to the one pixel are located in the middle pixel set in row 13, column r4, in a pixel array including the middle pixel set shown in FIG. 1(*a*)

In a second implementation shown in FIG. 9, in the middle pixel set in row 13, column r4, the red sub-pixel in row L6, column R10, a blue sub-pixel B in row L7, column R11, the supplementary-color sub-pixel X in row L8, column R10 and a green sub-pixel G in row L8, column R11 are four sub-pixels having different colors of a same pixel. In this implementation, sampling areas of sub-pixels of respective colors are overlapped orderly, and the overall sampling area has a relatively large area, which is suitable for displaying continuous images.

Needless to say, in the middle pixel region, four sub-pixels corresponding to each pixel of the image to be displayed may be four sub-pixels having different colors and located in different middle pixel sets.

Figure 10:
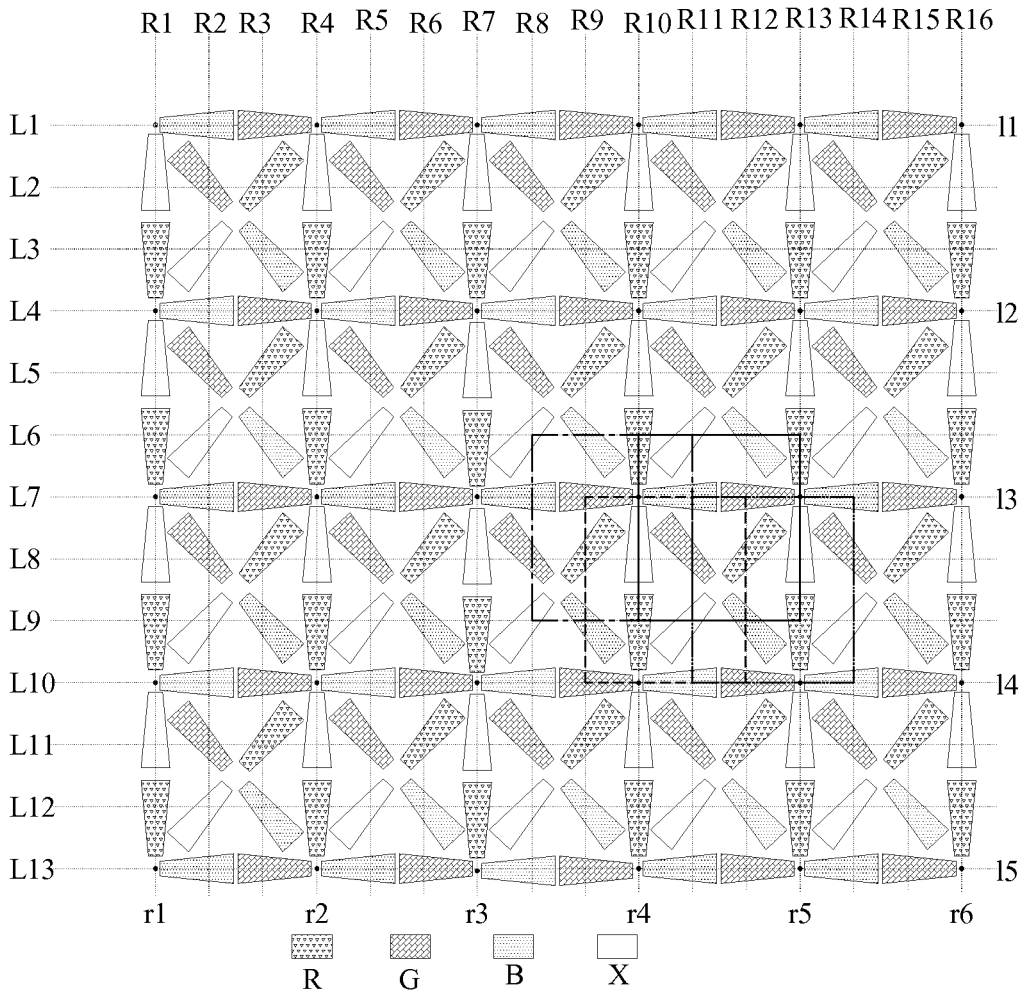
FIG. 10 illustrates sub-pixels which need to be used when calculating actual brightness values of respective sub-pixels in one pixel in an image to be displayed in the case that the sub-pixels corresponding to the one pixel are located in the middle pixel set in row 13, column r4, a middle pixel set in row 13, column r5 and a middle pixel set in row 14, column r5, in a pixel array including the middle pixel set shown in FIG. 1(*a*)

In a third implementation shown in FIG. 10, the supplementary-color sub-pixel X in row L8, column R10 in the middle pixel set in row 13, column r4, the green sub-pixel G in row L8, column R11 in the middle pixel set in row 13, column r4, the red sub-pixel R in row L8, column R12 in the middle pixel set in row 13, column r5 and the blue sub-pixel B in row L9, column R12 in the middle pixel set in row 14, column r5 are used for display one pixel of the image to be displayed.

Figure 11:
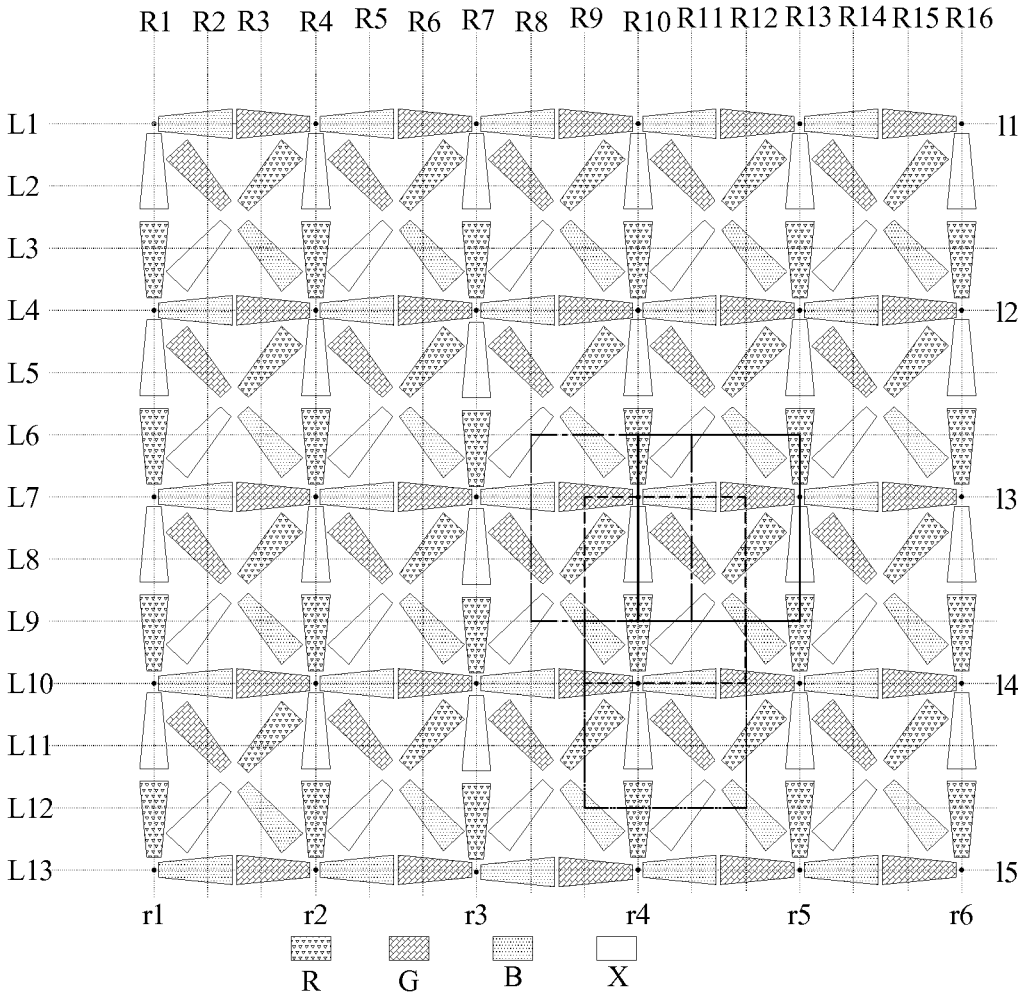
FIG. 11 illustrates sub-pixels which need to be used when calculating actual brightness values of respective sub-pixels in one pixel in an image to be displayed in the case that the sub-pixels corresponding to the one pixel are respectively located in the middle pixel set in row 13, column r4, the middle pixel set in row 13, column r5 and a middle pixel set in row 14, column r4, in a pixel array including the middle pixel set shown in FIG. 1(*a*)

In a fourth implementation shown in FIG. 11, the supplementary-color sub-pixel X in row L8, column R10 in the middle pixel set in row 13, column r4, the green sub-pixel G in row L8, column R11 in the middle pixel set in row 13, column r4, the red sub-pixel R in row L8, column R12 in the middle pixel set in row 13, column r5 and the blue sub-pixel B in row L10, column R11 in the middle pixel set in row 14, column r4 are used for display one pixel of the image to be displayed.

In the implementations shown in FIGS. 12 to 16, in each middle pixel set, two sub-pixels in the second row have the same color, and two sub-pixels in the second column have the same color. In this case, when the sub-pixel to be calculated is located in the middle pixel set, in step S2, the number of the sub-pixels surrounding the sub-pixel to be calculated and adjacent to and having the same color as the sub-pixel to be calculated is eight when one of the two sub-pixels in the second row is the sub-pixel to be calculated (i.e., when the actual brightness value of one of the two sub-pixels having the same color in the second row in the middle pixel set is calculated), and the number of the sub-pixels surrounding the sub-pixel to be calculated and adjacent to and having the same color as the sub-pixel to be calculated is eight when one of the two sub-pixels in the second column is the sub-pixel to be calculated (i.e., when the actual brightness value of one of the two sub-pixels having the same color in the second column in the middle pixel set is calculated). The number of the sub-pixels surrounding each of the remaining sub-pixels in the middle pixel set and adjacent to and having the same color as the sub-pixel is four.

Figure 12:
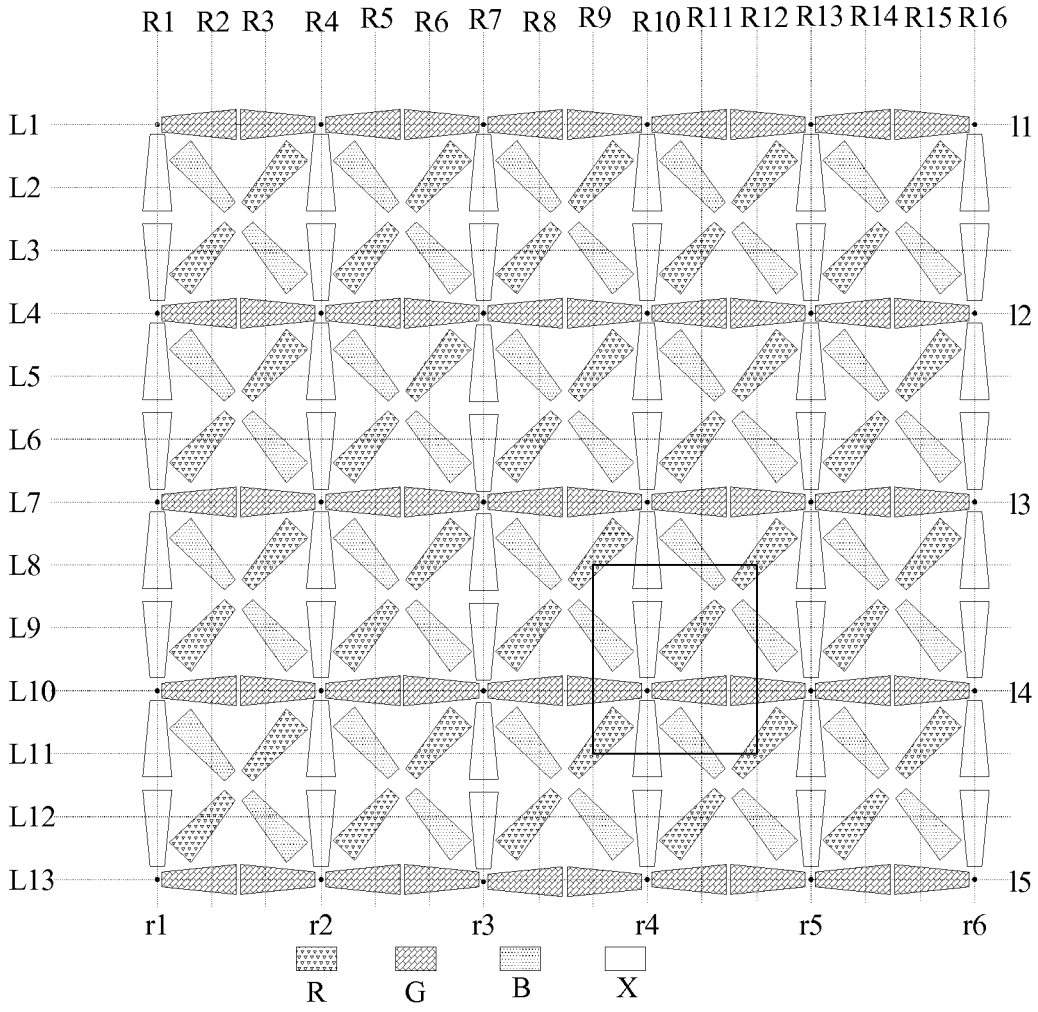
FIG. 12 illustrates sub-pixels which need to be used when calculating an actual brightness value of a sub-pixel in row L9, column R11, in a pixel array including a middle pixel set shown in FIG. 1(*b*)

Specifically, as shown in FIG. 12, when calculating the actual brightness value of a red sub-pixel R in row R9, column R11, in addition to the theoretical brightness value of the red sub-pixel R in row L9, column R11 itself, theoretical brightness values of a red sub-pixel R in row L8, column R9, a red sub-pixel R in row L8, column R12, a red sub-pixel R in row L11, column R9 and a red sub-pixel R in row L11, column R12 need to be used.

Figure 13:
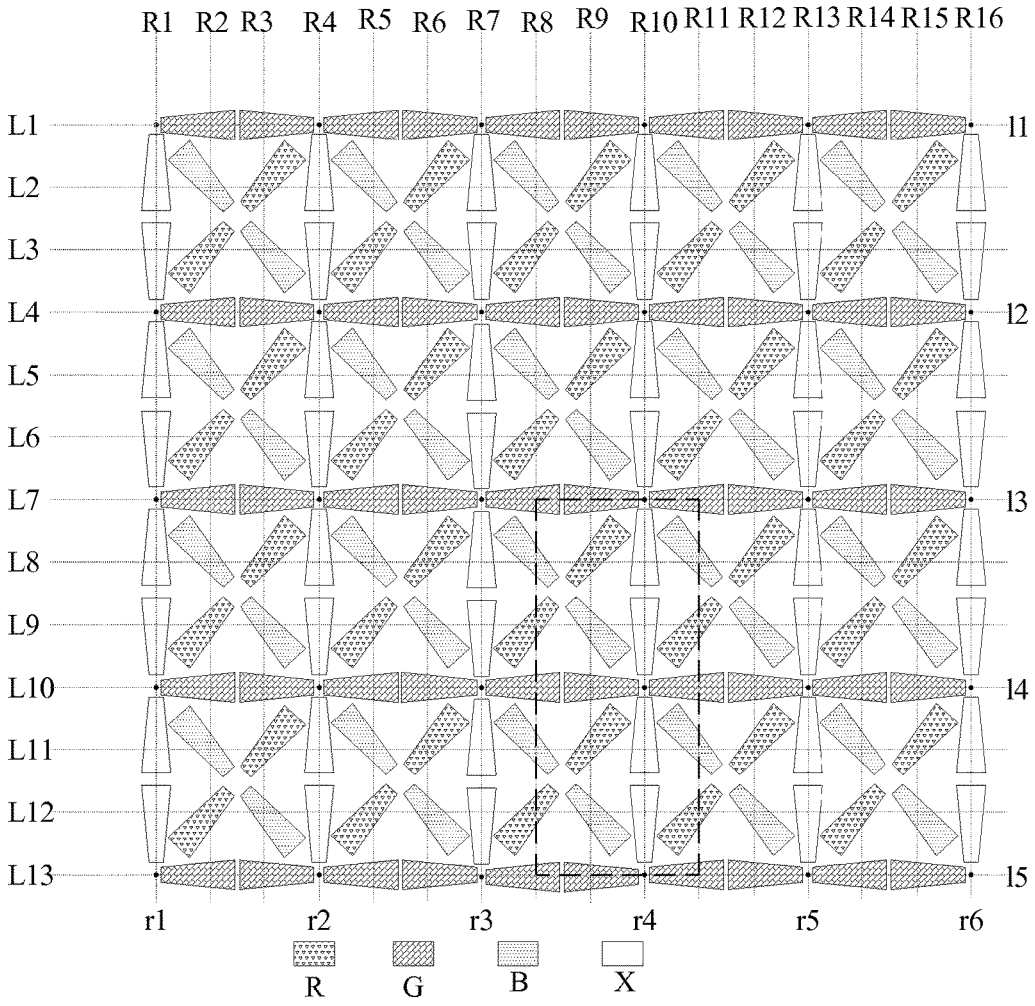
FIG. 13 illustrates sub-pixels which need to be used when calculating an actual brightness value of a sub-pixel in row L10, column R9, in a pixel array including the middle pixel set shown in FIG. 1(*b*)

As shown in FIG. 13, when calculating the actual brightness value of a green sub-pixel G in row L10, column R9, in addition to the theoretical brightness value of the green sub-pixel G in row L10, column R9 itself, theoretical brightness values of a green sub-pixel G in row L7, column R8, a green sub-pixel G in row L7, column R9, a green sub-pixel G in row L7, column R11, a green sub-pixel G in row L10, column R8, a green sub-pixel G in row L10, column R11, a green sub-pixel G in row L13, column R8, a green sub-pixel G in row L13, column R9 and a green sub-pixel G in row L13, column R11 need to be used.

Figure 14:
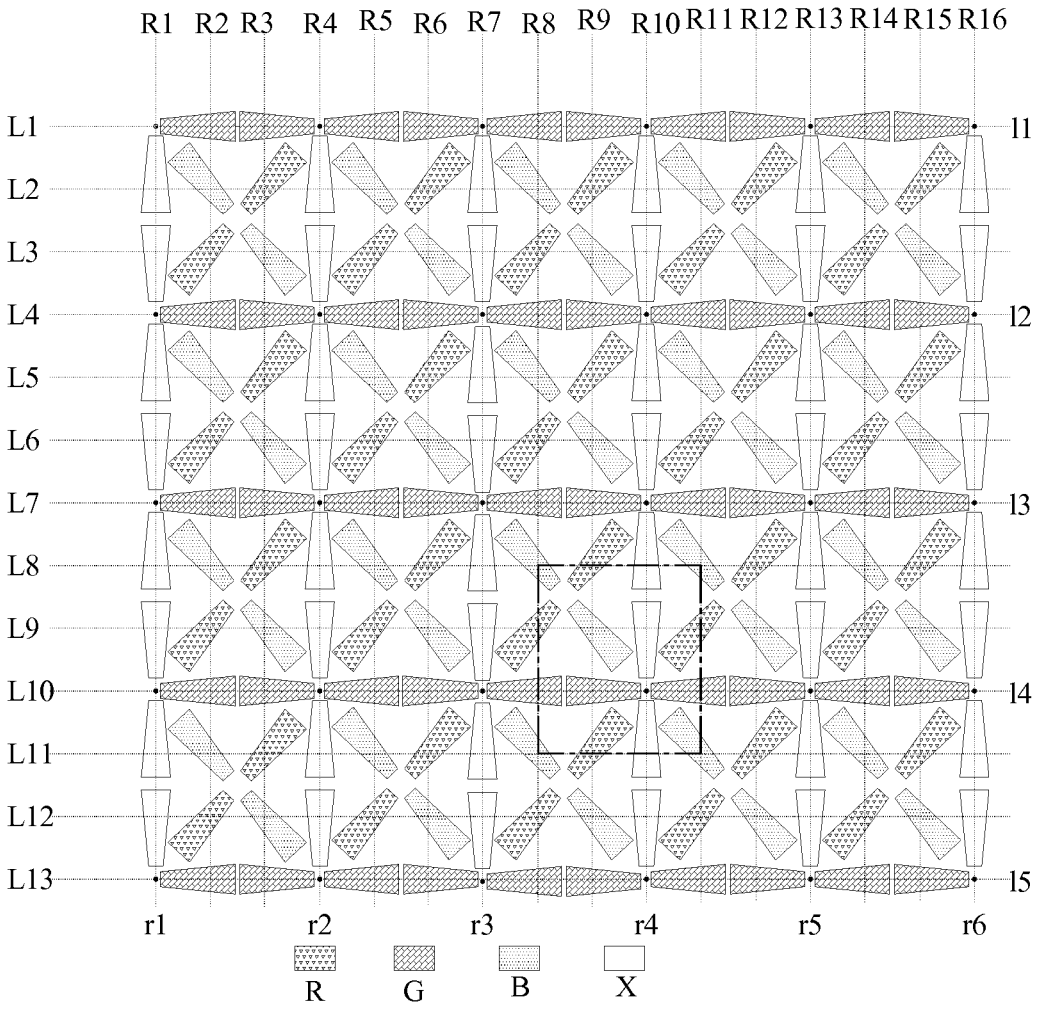
FIG. 14 illustrates sub-pixels which need to be used when calculating an actual brightness value of a sub-pixel in row L9, column R9, in a pixel array including the middle pixel set shown in FIG. 1(*b*)

As shown in FIG. 14, when calculating the actual brightness value of a blue sub-pixel B in row L9, column R9, in addition to the theoretical brightness value of the blue sub-pixel B in row L9, column R9 itself, theoretical brightness values of a blue sub-pixel B in row L8, column R8, a blue sub-pixel B in row L8, column R11, a blue sub-pixel B in row L11, column R8 and a blue sub-pixel B in row L11, column R11 need to be used.

Figure 15:
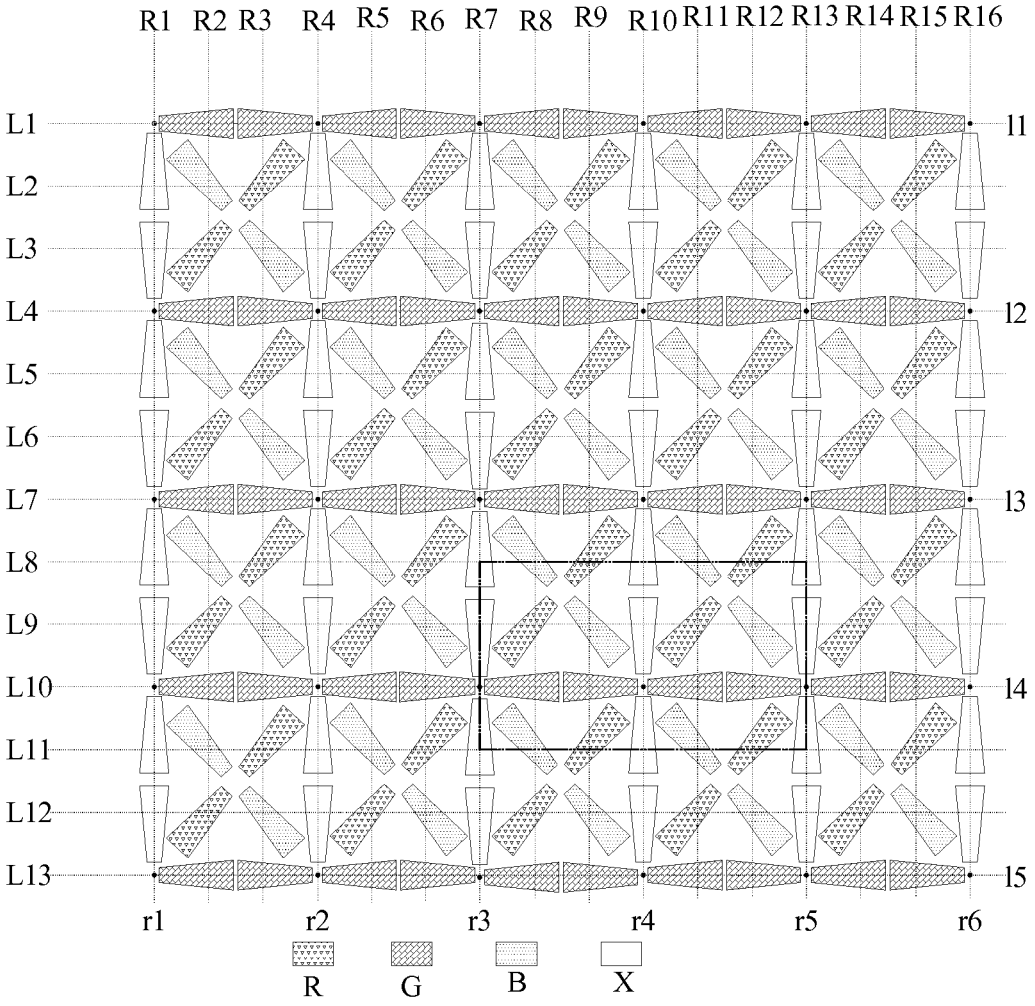
FIG. 15 illustrates sub-pixels which need to be used when calculating an actual brightness value of a sub-pixel in row L9, column R10, in a pixel array including the middle pixel set shown in FIG. 1(*b*)

As shown in FIG. 15, when calculating the actual brightness value of a supplementary-color sub-pixel X in row L9, column R10, in addition to the theoretical brightness value of the supplementary-color sub-pixel X in row L9, column R10 itself, theoretical brightness values of a supplementary-color sub-pixel X in row L8, column R7, a supplementary-color sub-pixel X in row L8, column R10, a supplementary-color sub-pixel in row L8, column R13, a supplementary-color sub-pixel in row L9, column R7, a supplementary-color sub-pixel in row L9, column R13, a supplementary-color sub-pixel X in row L11, column R7, a supplementary-color sub-pixel X in row L11, column R10 and a supplementary-color sub-pixel in row L11, column R13 need to be used.

Figure 16:
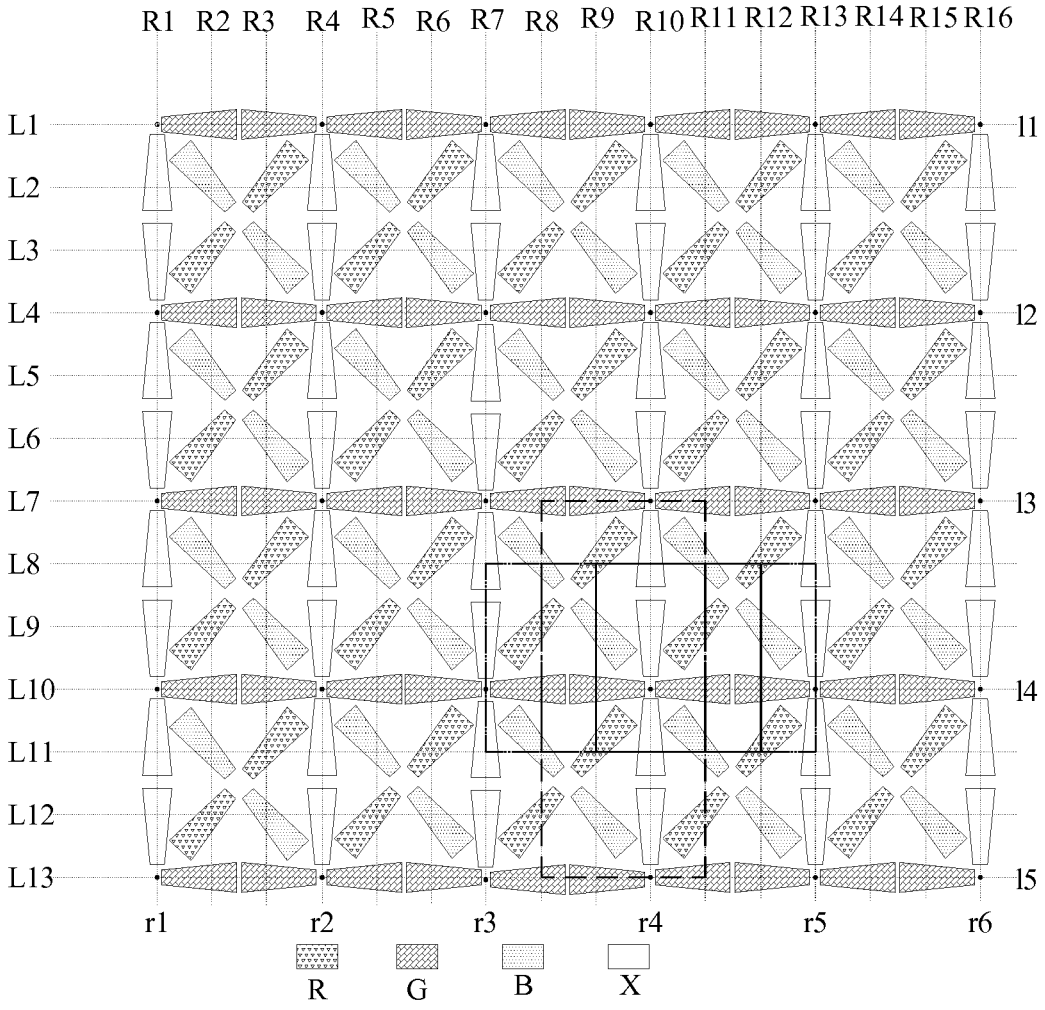
FIG. 16 illustrates sub-pixels which need to be used when calculating actual brightness values of respective sub-pixels in one pixel in an image to be displayed in the case that the sub-pixels corresponding to the one pixel are located in a middle pixel set in row 14, column r4, in a pixel array including the middle pixel set shown in FIG. 1(*b*).

In the implementations shown in FIGS. 12 to 15, in the middle pixel region, four sub-pixels corresponding to each pixel of the image to be displayed are four sub-pixels having different colors and in a same middle pixel set. As shown in FIG. 16, the blue sub-pixel B in row L9, column R9, the supplementary-color sub-pixel X in row L9, column R10, the red sub-pixel R in row L9, column R11 and the green sub-pixel G in row L10, column R9 in the middle pixel set in row 14, column r4 are the four sub-pixels corresponding to one pixel.

As another aspect of the present invention, there is provided a display panel, which comprises the pixel array provided by the present invention. The display panel may be a self-luminous display panel, and in this case, sub-pixels may be self-luminous devices such as organic light emitting diodes or the like. It can be seen from the above description that, the display panel provided by the present invention has reduced granular sensation, and achieves a display effect of a display panel with higher resolution in the same size.

As still another aspect of the present invention, there is provided a display device including the above display panel provided by the present invention. The display device may be a mobile phone, a computer or the like.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A pixel array, comprising a middle pixel region and an edge pixel region surrounding the middle pixel region, wherein, the middle pixel region comprises a plurality of middle pixel sets, each of which consists of eight sub-pixels arranged around a central point, the eight sub-pixels consist of two red sub-pixels, two green sub-pixels, two blue sub-pixels and two supplementary-color sub-pixels, and are arranged in three rows and three columns, the first row includes three sub-pixels, the second row includes two sub-pixels, and the third row includes three sub-pixels.

2. The pixel array according to claim 1, wherein, in each middle pixel set, the sub-pixels in the first row are a blue sub-pixel, a red sub-pixel and a supplementary-color sub-pixel sequentially, the sub-pixels in the second row are a green sub-pixel and a blue sub-pixel sequentially, and the sub-pixels in the third row are a red sub-pixel, a supplementary-color sub-pixel and a green sub-pixel sequentially; or in each middle pixel set, the sub-pixels in the first row are a blue sub-pixel, a supplementary-color sub-pixel and a red sub-pixel sequentially, the sub-pixels in the second row are a green sub-pixel and a green sub-pixel sequentially, and the sub-pixels in the third row are a red sub-pixel, a supplementary-color sub-pixel and a blue sub-pixel sequentially; or in each middle pixel set, the sub-pixels in the first row are a blue sub-pixel, a supplementary-color sub-pixel and a blue sub-pixel sequentially, the sub-pixels in the second row are a green sub-pixel and a supplementary-color sub-pixel sequentially, and the sub-pixels in the third row are a red sub-pixel, a green sub-pixel and a red sub-pixel sequentially; or in each middle pixel set, the sub-pixels in the first row are a blue sub-pixel, a blue sub-pixel and a supplementary-color sub-pixel sequentially, the sub-pixels in the second row are a green sub-pixel and a supplementary-color sub-pixel sequentially, and the sub-pixels in the third row are a green sub-pixel, a red sub-pixel and a red sub-pixel sequentially.

3. The pixel array according to claim 2, wherein, the supplementary-color sub-pixel is any one of a white sub-pixel, a yellow sub-pixel, an orange sub-pixel, a cyan sub-pixel and a purple sub-pixel.

4. The pixel array according to claim 3, wherein, each sub-pixel is of an elongated shape, and in each middle pixel set, the eight sub-pixels are radially arranged around the central point.

5. The pixel array according to claim 2, wherein, the edge pixel region comprises:

an upper edge region, comprising a plurality of upper edge pixel sets, each of which consists of five sub-pixels, which are the same as the sub-pixels in the second and third rows of one of the middle pixel sets, wherein, the upper edge pixel sets in the upper edge region are aligned with the middle pixel sets in respective columns in the middle pixel region, respectively;

a lower edge region, comprising a plurality of lower edge pixel sets, each of which consists of five sub-pixels, which are the same as the sub-pixels in the first and second rows of one of the middle pixel sets, wherein, the lower edge pixel sets in the lower edge region are aligned with the middle pixel sets in the respective columns in the middle pixel region, respectively;

a left edge region, comprising a plurality of left edge pixel sets, each of which consists of five sub-pixels, which are the same as the sub-pixels in the second and third columns of one of the middle pixel sets, wherein, the left edge pixel sets in the left edge region are aligned with the middle pixel sets in respective rows in the middle pixel region, respectively;

a right edge region, comprising a plurality of right edge pixel sets, each of which consists of five sub-pixels, which are the same as the sub-pixels in the first and second columns of one of the middle pixel sets;

a top left corner pixel set, which is located on the left side of the upper edge region and on the upper side of the left edge region and consists of three sub-pixels, which are the sub-pixel in row two, column three of one of the middle pixel sets, the sub-pixel in row three, column three of one of the middle pixel sets and the sub-pixel in row three, column two of one of the middle pixel sets, respectively;

a top right corner pixel set, which is located on the right side of the upper edge region and on the upper side of the right edge region and consists of three sub-pixels, which are the sub-pixel in row two, column one of one of the middle pixel sets, the sub-pixel in row three, column one of one of the middle pixel sets and the sub-pixel in row three, column two of one of the middle pixel sets, respectively;

a bottom left corner pixel set, which is located on the lower side of the left edge region and on the left side of the lower edge region and consists of three sub-pixels, which are the sub-pixel in row one, column two of one of the middle pixel sets, the sub-pixel in row one, column three of one of the middle pixel sets and the sub-pixel in row two, column three of one of the middle pixel sets, respectively; and a bottom right corner pixel set, which is located on the lower side of the right edge region and on the right side of the lower edge region and consists of three sub-pixels, which are the sub-pixel in row one, column one of one of the middle pixel sets, the sub-pixel in row one, column two of one of the middle pixel sets and the sub-pixel in row two, column one of one of the middle pixel sets, respectively.

6. The pixel array according to claim 1, wherein, the supplementary-color sub-pixel is any one of a white sub-pixel, a yellow sub-pixel, an orange sub-pixel, a cyan sub-pixel and a purple sub-pixel.

7. The pixel array according to claim 6, wherein, each sub-pixel is of an elongated shape, and in each middle pixel set, the eight sub-pixels are radially arranged around the central point.

8. The pixel array according to claim 1, wherein, the edge pixel region comprises:

an upper edge region, comprising a plurality of upper edge pixel sets, each of which consists of five sub-pixels, which are the same as the sub-pixels in the second and third rows of one of the middle pixel sets, wherein, the upper edge pixel sets in the upper edge region are aligned with the middle pixel sets in respective columns in the middle pixel region, respectively;

a lower edge region, comprising a plurality of lower edge pixel sets, each of which consists of five sub-pixels, which are the same as the sub-pixels in the first and second rows of one of the middle pixel sets, wherein, the lower edge pixel sets in the lower edge region are aligned with the middle pixel sets in the respective columns in the middle pixel region, respectively;

a left edge region, comprising a plurality of left edge pixel sets, each of which consists of five sub-pixels, which are the same as the sub-pixels in the second and third columns of one of the middle pixel sets, wherein, the left edge pixel sets in the left edge region are aligned with the middle pixel sets in respective rows in the middle pixel region, respectively;

a right edge region, comprising a plurality of right edge pixel sets, each of which consists of five sub-pixels, which are the same as the sub-pixels in the first and second columns of one of the middle pixel sets;

a top left corner pixel set, which is located on the left side of the upper edge region and on the upper side of the left edge region and consists of three sub-pixels, which are the sub-pixel in row two, column three of one of the middle pixel sets, the sub-pixel in row three, column three of one of the middle pixel sets and the sub-pixel in row three, column two of one of the middle pixel sets, respectively;

a top right corner pixel set, which is located on the right side of the upper edge region and on the upper side of the right edge region and consists of three sub-pixels, which are the sub-pixel in row two, column one of one of the middle pixel sets, the sub-pixel in row three, column one of one of the middle pixel sets and the sub-pixel in row three, column two of one of the middle pixel sets, respectively;

a bottom left corner pixel set, which is located on the lower side of the left edge region and on the left side of the lower edge region and consists of three sub-pixels, which are the sub-pixel in row one, column two of one of the middle pixel sets, the sub-pixel in row one, column three of one of the middle pixel sets and the sub-pixel in row two, column three of one of the middle pixel sets, respectively; and a bottom right corner pixel set, which is located on the lower side of the right edge region and on the right side of the lower edge region and consists of three sub-pixels, which are the sub-pixel in row one, column one of one of the middle pixel sets, the sub-pixel in row one, column two of one of the middle pixel sets and the sub-pixel in row two, column one of one of the middle pixel sets, respectively.

9. A driving method for driving the pixel array of claim 1, the driving method comprising steps of:

S1, calculating theoretical brightness values of respective sub-pixels for an image to be displayed according to colors of respective pixels of the image to be displayed;

S2, calculating actual brightness values of the respective sub-pixels, wherein, the actual brightness value of each sub-pixel to be calculated includes a sum of a part of the theoretical brightness value of the sub-pixel to be calculated and at least a part of the theoretical brightness value of at least one sub-pixel adjacent to and having the same color as the sub-pixel to be calculated; and S3, inputting signals to the respective sub-pixels so as to cause brightnesses of the respective sub-pixels to reach the actual brightness values calculated at step S2.

10. The driving method according to claim 9, wherein, when the sub-pixel to be calculated is located in one of the middle pixel sets, in step S2, the actual brightness value of the sub-pixel to be calculated comprises a sum of a part of the theoretical brightness value of the sub-pixel to be calculated and at least parts of the theoretical brightness values of a plurality of sub-pixels adjacent to and having the same color as the sub-pixel to be calculated, and the plurality of sub-pixels adjacent to the sub-pixel to be calculated surround the sub-pixel to be calculated.

11. The driving method according to claim 10, wherein, in the pixel array, any two adjacent sub-pixels have different colors, and in step S2, the number of the sub-pixels surrounding the sub-pixel to be calculated and adjacent to and having the same color as the sub-pixel to be calculated is four.

12. The driving method according to claim 11, wherein, in the middle pixel region, four sub-pixels corresponding to each pixel of the image to be displayed are four sub-pixels having different colors and in a same middle pixel set.

13. The driving method according to claim 11, wherein, in the middle pixel region, four sub-pixels corresponding to each pixel of the image to be displayed are four sub-pixels having different colors and located in different middle pixel sets.

14. The driving method according to claim 10, wherein, in the pixel array, in each middle pixel set, two sub-pixels in the second row have the same color, and two sub-pixels in the second column have the same color; when the sub-pixel to be calculated is located in one of the middle pixel sets, in step S2, the number of the sub-pixels surrounding the sub-pixel to be calculated and adjacent to and having the same color as the sub-pixel to be calculated is eight when one of the two sub-pixels in the second row is the sub-pixel to be calculated, and the number of the sub-pixels surrounding the sub-pixel to be calculated and adjacent to and having the same color as the sub-pixel to be calculated is eight when one of the two sub-pixels in the second column is the sub-pixel to be calculated.

15. The driving method according to claim 14, wherein, in the middle pixel region, four sub-pixels corresponding to each pixel of the image to be displayed are four sub-pixels having different colors and in a same middle pixel set.

16. A display device, comprising a pixel array comprising a middle pixel region and an edge pixel region surrounding the middle pixel region, wherein, the middle pixel region comprises a plurality of middle pixel sets, each of which consists of eight sub-pixels arranged around a central point, the eight sub-pixels consist of two red sub-pixels, two green sub-pixels, two blue sub-pixels and two supplementary-color sub-pixels, and are arranged in three rows and three columns, the first row includes three sub-pixels, the second row includes two sub-pixels, and the third row includes three sub-pixels.

17. The display device according to claim 16, wherein, in each middle pixel set, the sub-pixels in the first row are a blue sub-pixel, a red sub-pixel and a supplementary-color sub-pixel sequentially, the sub-pixels in the second row are a green sub-pixel and a blue sub-pixel sequentially, and the sub-pixels in the third row are a red sub-pixel, a supplementary-color sub-pixel and a green sub-pixel sequentially; or in each middle pixel set, the sub-pixels in the first row are a blue sub-pixel, a supplementary-color sub-pixel and a red sub-pixel sequentially, the sub-pixels in the second row are a green sub-pixel and a green sub-pixel sequentially, and the sub-pixels in the third row are a red sub-pixel, a supplementary-color sub-pixel and a blue sub-pixel sequentially; or in each middle pixel set, the sub-pixels in the first row are a blue sub-pixel, a supplementary-color sub-pixel and a blue sub-pixel sequentially, the sub-pixels in the second row are a green sub-pixel and a supplementary-color sub-pixel sequentially, and the sub-pixels in the third row are a red sub-pixel, a green sub-pixel and a red sub-pixel sequentially; or in each middle pixel set, the sub-pixels in the first row are a blue sub-pixel, a blue sub-pixel and a supplementary-color sub-pixel sequentially, the sub-pixels in the second row are a green sub-pixel and a supplementary-color sub-pixel sequentially, and the sub-pixels in the third row are a green sub-pixel, a red sub-pixel and a red sub-pixel sequentially.

18. The display device according to claim 16, wherein, the supplementary-color sub-pixel is any one of a white sub-pixel, a yellow sub-pixel, an orange sub-pixel, a cyan sub-pixel and a purple sub-pixel.

19. The display device according to claim 18, wherein, each sub-pixel is of an elongated shape, and in each middle pixel set, the eight sub-pixels are radially arranged around the central point.

20. The display device according to claim 16, wherein, the edge pixel region comprises:

an upper edge region, comprising a plurality of upper edge pixel sets, each of which consists of five sub-pixels, which are the same as the sub-pixels in the second and third rows of one of the middle pixel sets wherein, the upper edge pixel sets in the upper edge region are aligned with the middle pixel sets in respective columns in the middle pixel region, respectively;

a lower edge region, comprising a plurality of lower edge pixel sets, each of which consists of five sub-pixels, which are the same as the sub-pixels in the first and second rows of one of the middle pixel sets, wherein, the lower edge pixel sets in the lower edge region are aligned with the middle pixel sets in the respective columns in the middle pixel region, respectively;

a left edge region, comprising a plurality of left edge pixel sets, each of which consists of five sub-pixels, which are the same as the sub-pixels in the second and third columns of one of the middle pixel sets, wherein, the left edge pixel sets in the left edge region are aligned with the middle pixel sets in respective rows in the middle pixel region, respectively;

a right edge region, comprising a plurality of right edge pixel sets, each of which consists of five sub-pixels, which are the same as the sub-pixels in the first and second columns of one of the middle pixel sets;

a top left corner pixel set, which is located on the left side of the upper edge region and on the upper side of the left edge region and consists of three sub-pixels, which are the sub-pixel in row two, column three of one of the middle pixel sets, the sub-pixel in row three, column three of one of the middle pixel sets and the sub-pixel in row three, column two of one of the middle pixel sets, respectively;

a top right corner pixel set, which is located on the right side of the upper edge region and on the upper side of the right edge region and consists of three sub-pixels, which are the sub-pixel in row two, column one of one of the middle pixel sets, the sub-pixel in row three, column one of one of the middle pixel sets and the sub-pixel in row three, column two of one of the middle pixel sets, respectively;

a bottom left corner pixel set, which is located on the lower side of the left edge region and on the left side of the lower edge region and consists of three sub-pixels, which are the sub-pixel in row one, column two of one of the middle pixel sets, the sub-pixel in row one, column three of one of the middle pixel sets and the sub-pixel in row two, column three of one of the middle pixel sets, respectively; and a bottom right corner pixel set, which is located on the lower side of the right edge region and on the right side of the lower edge region and consists of three sub-pixels, which are the sub-pixel in row one, column one of one of the middle pixel sets, the sub-pixel in row one, column two of one of the middle pixel sets and the sub-pixel in row two, column one of one of the middle pixel sets, respectively.

* * * * *